US007152249B2

(12) United States Patent
Geng

(10) Patent No.: US 7,152,249 B2
(45) Date of Patent: Dec. 26, 2006

(54) METHOD FOR ASSEMBLING STRING KNIT GLOVE WITH LEATHER PALM

(75) Inventor: Tony Geng, Ontario (CA)

(73) Assignee: Superior Glove Works Limited, Acton (CA)

( * ) Notice: Subject to any disclaimer, the term of this patent is extended or adjusted under 35 U.S.C. 154(b) by 53 days.

(21) Appl. No.: 10/900,126

(22) Filed: Jul. 28, 2004

(65) Prior Publication Data

US 2005/0278829 A1 Dec. 22, 2005

(30) Foreign Application Priority Data

Jun. 18, 2004 (CA) ..... 2471663

(51) Int. Cl.
*A41D 19/00* (2006.01)

(52) U.S. Cl. ..... 2/161.6; 2/169

(58) Field of Classification Search ..... 2/169, 2/161.6

See application file for complete search history.

(56) References Cited

U.S. PATENT DOCUMENTS

| | | | | | |
|---|---|---|---|---|---|
| 1,471,801 | A * | 10/1923 | Neal | ..... | 2/161.6 |
| 2,234,664 | A * | 3/1941 | Banovic | ..... | 2/169 |
| 2,299,118 | A * | 10/1942 | Wheeler | ..... | 2/159 |
| 2,632,171 | A * | 3/1953 | Kuh | ..... | 2/161.6 |
| 5,117,509 | A * | 6/1992 | Bowers | ..... | 2/161.1 |
| 6,185,747 | B1 * | 2/2001 | Hughes | ..... | 2/161.6 |
| 6,415,443 | B1 * | 7/2002 | Schierenbeck et al. | ..... | 2/159 |
| 6,957,448 | B1 * | 10/2005 | Grilliot et al. | ..... | 2/161.6 |

* cited by examiner

*Primary Examiner*—Katherine M. Moran
(74) *Attorney, Agent, or Firm*—Ingrid E. Schmidt

(57) ABSTRACT

A glove having a string knit body has a leather palm which is assembled to the string knit body with a narrow band of fabric secured at its edges to the string knit body and the leather palm. Seams are turned inside the glove but outside the string knit body and the narrow band of fabric spaces the leather from the string knit body to improve comfort.

9 Claims, 3 Drawing Sheets

METHOD FOR ASSEMBLING STRING KNIT GLOVE WITH LEATHER PALM

FIELD OF INVENTION

This invention relates to a glove which features a tubular string knit body that is breathable and flexible and a leather piece covering the palm, thumb and bottom of the fingers for protection against cuts and scrapes to the hand. A glove of this kind is commonly used by workers who assemble or fit metal parts which often have sharp edges and which can easily cut through cloth and cause injury.

BACKGROUND OF THE INVENTION

String knit gloves are fabricated as a tubular body and are seamless. They are convenient to use because they are flexible allowing users freedom of movement and maximizing dexterity. Because they are a knit, air can pass through and this improves comfort as otherwise the hands may get too hot. For additional protection against cuts, it is desirable to apply a leather or simulated leather exterior to the palm surface of the glove and to the thumb and bottom of the fingers.

Assembly of a leather piece to a tubular string knit glove is quite difficult and requires the use of a special post stitch sewing machine to follow the contour of the leather piece from inside the string knit glove without attaching the back of the glove to the palm of the glove. Because this is a labor intensive task, the resulting product is quite costly and as a result it is not commercially desirable unless valuable quality materials are used to construct the glove such as a string knit made from KEVLAR fibers.

An object of this invention is to provide a glove having a string knit body and a leather piece attached to the string knit body which is less expensive to fabricate so that the glove can be made more readily available.

SUMMARY OF THE INVENTION

In accordance with the invention, there is provided a glove having a tubular string knit body, an elongate narrow band of fabric having two edges stitched along its length on one edge to the tubular knit body, and on the other edge to a palm covering element of durable material, the fabric band Thereby securing the palm covering element to the tubular string knit glove body and spacing the palm covering element from the tubular string knit glove body to accommodate a hand received in the glove.

The invention also provides a method of assembling the string knit body to a palm covering element made of durable material.

DETAILED DESCRIPTION

Figure 1:
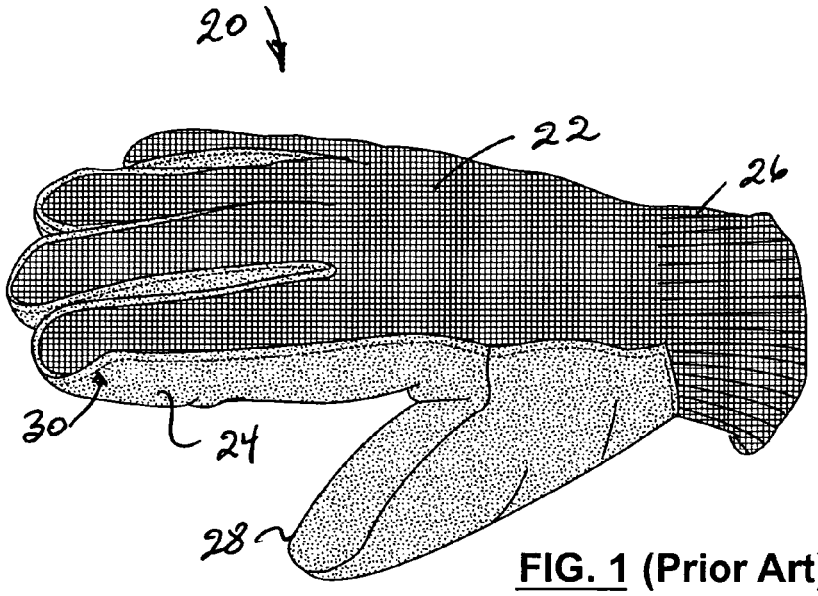
FIG. 1 (Prior Art)
FIG. 1 is a perspective view of a glove having a tubular string knit body and a leather piece attached to the body in accordance with the prior art
Figure 2:
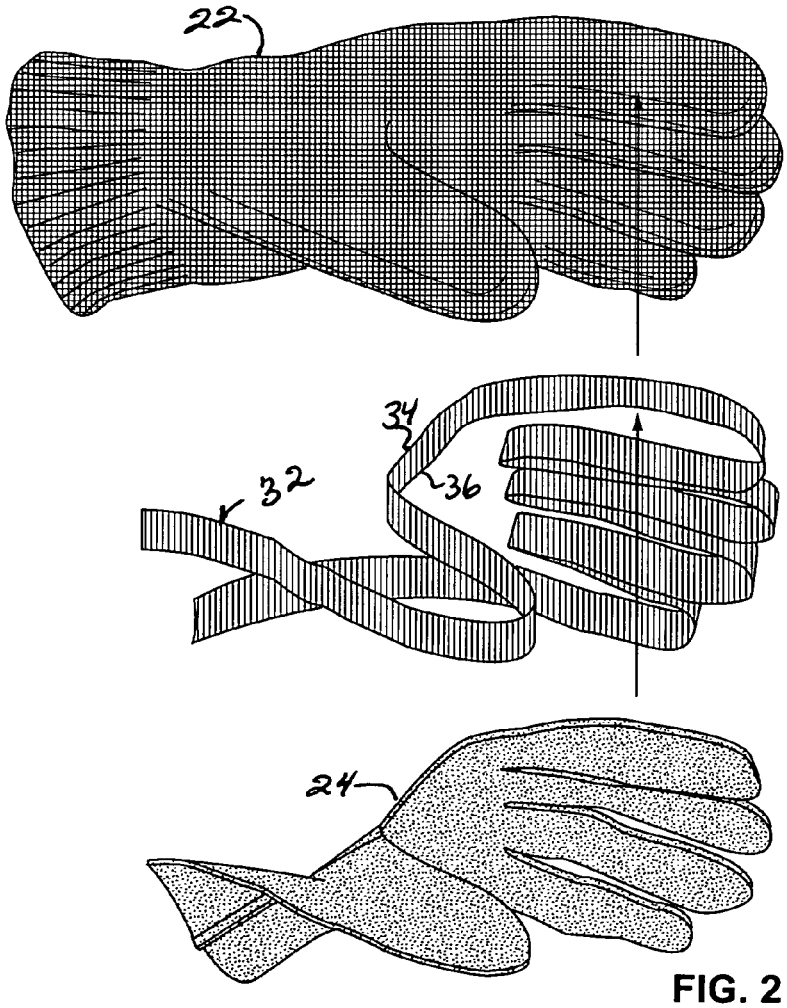
FIG. 2 is a perspective view of a tubular string knit glove, a band of fabric, and a leather piece for assembly into a glove in accordance with the invention.

A glove 20 having a string knit body 22 and a leather piece 24 attached to the body in accordance with the prior art is shown in FIG. 1. The string knit body is fabricated as a tubular body and is seamless. The filaments used for knitting the string knit body may be made from a number of fiber materials such as cotton, polyester, acrylic, aramid (i.e. KELVAR, NOMEX), rayon, polypropylene, ramie, polyethylene (le. SPECTRA), stainless steel filament yam and any combination and blends thereof. KEVLAR and NOMEX are registered trademarks of E.I. du Pont de Nemours and Company. SPECTRA is a registered trademark of Honeywell. Because of the expense of assembling the leather piece 24 to the string knit body 22 by the prior art method using a post stitch sewing machine, it is common for the string knit body to be fabricated from more valuable material such as KELVAR fibers. The leather piece 24 is shaped to cover the palm of the glove 20 and to cover the entire thumb as well as the bottom of the fingers for protection against cuts and scrapes to the hand. It will be understood that the term "leather" is used generically throughout the description and is not intended to be limited to a natural leather material but could include natural leather. synthetic leather, nitrile coated fabric, vinyl coated fabric, polyethylene coated fabric, and silicone coated fabric, and other such materials which provide more cut and abrasion resistance than the basic string knit body to which it is attached. As in all gloves, the glove 20 has a cuff 26 which Is open in order to receive a hand (not shown). In the embodiment illustrated, the cuff is elasticized so that it may be stretched to a greater diameter to receive the hand. Other styles of cuffs may also be used which may or may not be integral with the string knit body 22.

During assembly of the prior art glove 20 illustrated in FIG. 1, the leather piece 24 is pre-assembled so that, for example, a number of components may be coupled together to form the thumb 28. The pre-assembled leather piece 24 is then pinned to the exterior surface of the string knit body 22 and a post is inserted into the interior cavity and moved to trace the peripheral portions of the leather piece 24 in order to stitch the leather piece to the exterior of the string knit body 22. The resulting stitch line is generally indicated in FIG. 1 by reference numeral 30.

The assembly of a leather piece 24 to a string knit body 22 in accordance with the invention will now be described with reference to FIGS. 2 to 7 where like numerals are used to identify like parts.

A palm covering element 24 made of durable material, in this case, leather, is first coupled to an elongate narrow band of fabric 32 such as a cotton ribbon having two spaced edges 34, 36. The fabric band 32 may be made from cotton, polyester, nylon, acrylic, aramid, rayon, ramie, polypropylene and polyethylene. A first seam 38 is formed by coupling a first edge 34 of the fabric band 32 to the peripheral edge of the leather piece 24. The seam 38 may be seen with reference to FIGS. 3 to 5 where it is shown as a line of stitching. The opposite edge 36 of the fabric band 32 is then coupled to the string knit body 22 to form a second seam 40. The fabric band may be made from materials selected from the group comprising: cotton, LYCRA, NYLON or any other suitable fabric which is easily stitched to or otherwise coupled to the leather piece 24 and string knit body 22.

Conveniently, the fabric band 22 is secured by stitching which is shown at the seams 38, 40.

Figure 3:
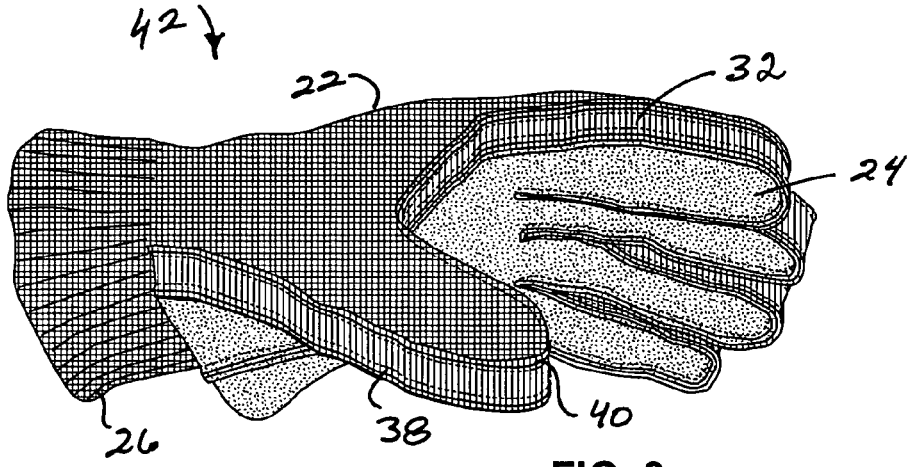
FIG. 3 is a perspective view from the top of a partially assembled glove in accordance with the invention.
Figure 5:
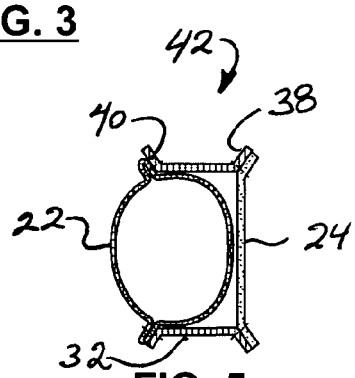
FIG. 5 is a cross-sectional view taken on line 5—5 of FIG. 4.
Figure 4:
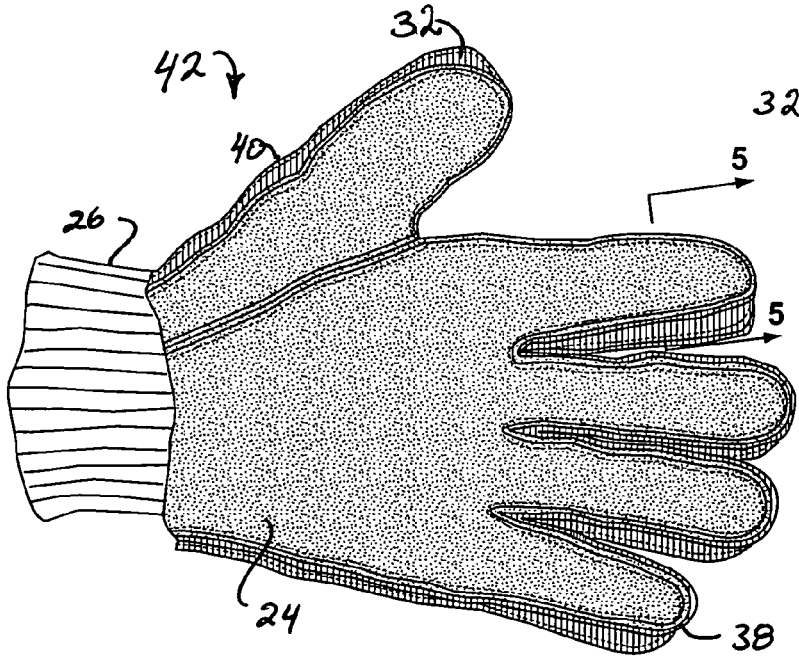
FIG. 4 is a perspective view from the bottom of the partially assembled glove of FIG. 3.

As will be apparent from the cross-sectional view of FIG. 5, the fabric band 32 not only couples the leather piece 24 to the string knit body 22 but also spaces the leather piece 24 from the string knit body 22 to define a greater space to accommodate a hand received in the glove. The glove assembly is generally indicated in FIGS. 3 and 4 by reference numeral 42. As can be seen most clearly in FIG. 3, the glove assembly 42 has a portion adjacent to the cuff 26 where the leather piece 24 is unattached to the string knit glove 22.

In the glove assembly 42 illustrated by FIGS. 3 and 4, the leather piece 24 covers a backside of the glove. By turning the string knit body 22 so that the leather piece 24 covers a palm side of the glove opposite from said backside, the seams 38, 40 are placed on an interior surface of the glove assembly 42 so that they are hidden from view as shown by FIGS. 6 and 7.

Figure 7:
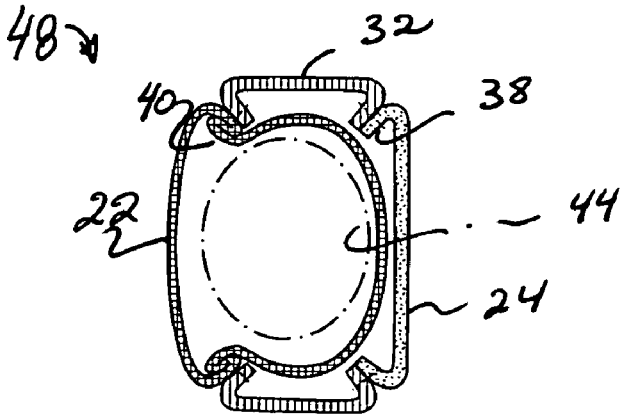
FIG. 7 (drawn to a larger scale) is a perspective view taken on line 7—7 of FIG. 6.

From FIG. 7 it will further be appreciated that fabric band 32 also serves to space the interior seam 40 from the leather piece 24 so that its bulk is removed from the sensitive areas of the hand 44 indicated in ghost outline in FIG. 7 and which bear against the leather piece 24 during use of the glove.

Figure 6:
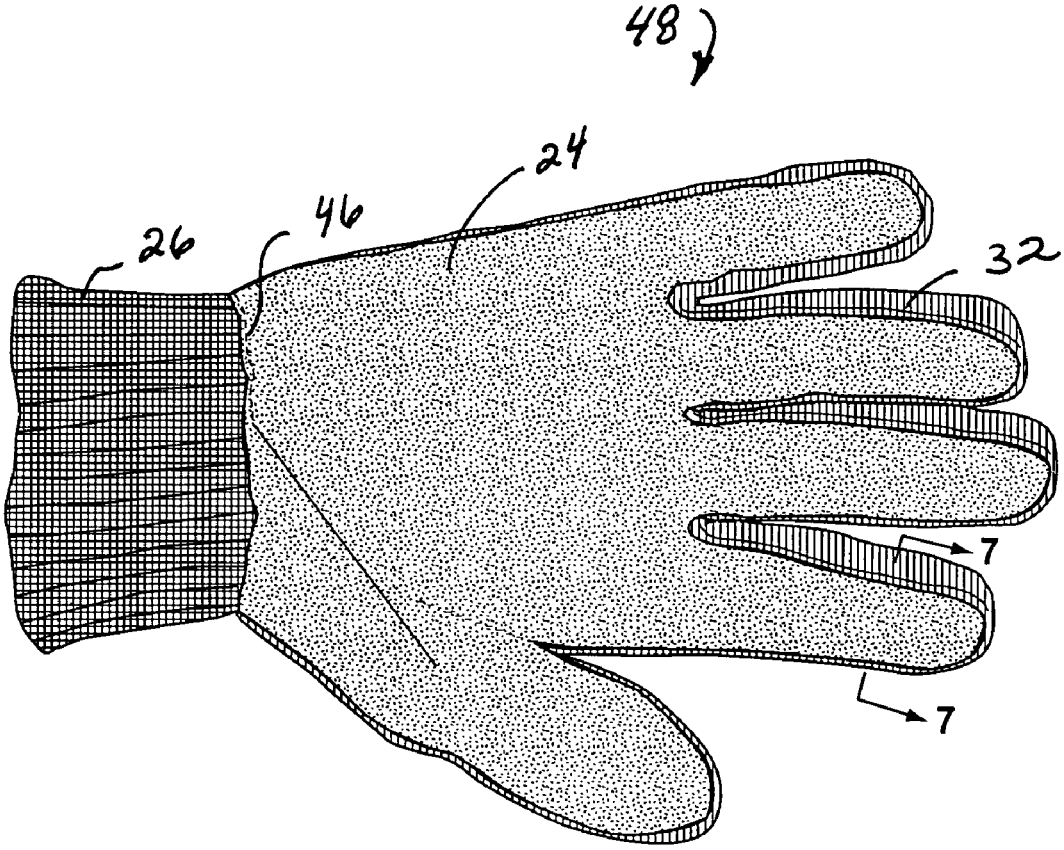
FIG. 6 is a perspective view of the assembled glove turned so that the seams are on the interior.

The glove assembly is completed by securing the leather piece 24 to the string knit body 22 at the cuff 26 by stitching same as indicated by stitch line 46 in FIG. 6. The resulting glove 48 (FIG. 6) has an open cuff 26 for receiving a hand (not shown) which consists of a string knit body 22 and elongate narrow band 32 of fabric having two edges secured along its length on one edge to the knit body and following a contour of the body from one side of the cuff 26 to the other side of the cuff 26, the band being secured on the other edge to the leather piece 24, the fabric band thereby securing the leather piece to the string knit body 48. The resulting glove 48 has a neat finished appearance in which seams are concealed so that they will not fray or otherwise interfere with use of the glove while still being positioned such that they will not hinder the user's freedom of movement and comfort using the glove.

It will be appreciated that several variations may be made to the above described preferred embodiment of a glove made in accordance with the invention within the scope of the appended claims. In particular, it will be appreciated that the nature of the materials comprising the string knit body 22 and the leather piece 24 as well as the fabric band 32 may be chosen by the user to suit the intended application and they are not limited to the proposed materials described.

The invention claimed is:

1. A method of assembling a glove having a tubular string knit body to a palm covering element made of durable material, the method comprising the following steps:

coupling an elongate narrow band of fabric having two spaced edges to the palm covering element along a first said edge, coupling the band of fabric to the tubular string knit body along a second said edge to form a glove assembly, and securing the assembly so that the palm covering element is attached to the tubular string knit body along a peripheral edge of the palm covering element.

2. A method of assembling a glove having a tubular string knit body to a palm covering element made of durable material, the tubular string knit body having an open cuff to receive a hand and the palm covering element having a periphery which outlines the shape of a hand, the method comprising the following steps:

coupling a first edge of an elongate narrow band of fabric having two spaced edges to the palm covering element along the periphery to form a first seam;

coupling the band of fabric to the tubular string knit body along a second said edge to form a second seam and define a glove assembly in which the palm covering element is unattached to the tubular string knit glove body at the cuff and covers a backside of the glove;

turning the tubular string knit body so that the palm covering element covers a palm side of the glove opposite from said backside so that the seams are on an interior surface of the glove;

and securing the palm covering element to the tubular string knit body at the cuff.

3. Method according to claim 2 in which the narrow band of fabric is coupled to the palm covering element and to the tubular string knit body by stitching.

4. A glove made by a method according to claim 2.

5. A glove made by a method according to claim 3.

6. A glove having a tubular string knit body with an open cuff to receive a hand, an elongate narrow band of fabric having two edges secured along its length on one edge to the tubular string knit body and following a contour of the tubular string knit body from one side of the cuff to another side of the cuff, the band being secured on the other edge to a palm covering element made of durable material, the fabric band thereby securing the palm covering element to the tubular string knit body and spacing the palm covering element from the tubular string knit body to accommodate a hand received in the glove.

7. A glove according to claim 6 in which the tubular string knit body is made from knitted filaments consisting of material selected from the group comprising: cotton, polyester, nylon, acrylic, aramid, rayon, polypropylene, ramie, polyethylene, stainless steel filament yarn and any combination and blends thereof.

8. A glove according to claim 6 in which the palm covering element consists of durable material selected from the group comprising: natural leather, synthetic leather, nitrile coated fabric, vinyl coated fabric, polyethylene coated fabric, and silicone coated fabric.

9. A glove according to claim 6 in which the band of fabric is made from material selected from the group comprising: cotton, polyester, nylon, acrylic, aramid, rayon, ramie, polypropylene and polyethylene.

* * * * *